US011408694B2

(12) United States Patent
Al-Otaibi

(10) Patent No.: US 11,408,694 B2
(45) Date of Patent: Aug. 9, 2022

(54) RECIPROCATING SPRAY CLEANING SYSTEM FOR AIR-COOLED HEAT EXCHANGERS

(71) Applicant: Saudi Arabian Oil Company, Dhahran (SA)

(72) Inventor: Abdullah M. Al-Otaibi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 228 days.

(21) Appl. No.: 16/824,336

(22) Filed: Mar. 19, 2020

(65) Prior Publication Data

US 2021/0291206 A1 Sep. 23, 2021

(51) Int. Cl.
*F28G 15/02* (2006.01)
*B05B 1/20* (2006.01)
(Continued)

(52) U.S. Cl.
CPC ..... *F28G 15/02* (2013.01); *B05B 1/20* (2013.01); *B05B 3/18* (2013.01); *F28F 1/10* (2013.01); *F28G 1/166* (2013.01); *F28G 15/04* (2013.01); *F28F 2265/18* (2013.01); *F28F 2280/10* (2013.01)

(58) Field of Classification Search
CPC ..... F28G 15/02; F28G 15/04; F28G 1/166; F28G 1/16; F28G 1/12; B05B 1/20; B05B 3/18; B05B 5/1633
See application file for complete search history.

(56) References Cited

U.S. PATENT DOCUMENTS 5,195,334 A * 3/1993 Lang ..... F28G 1/166 62/303
5,279,357 A * 1/1994 Kennon ..... F28G 3/166 122/391
(Continued)

FOREIGN PATENT DOCUMENTS

DE 10 2011 113377 A1 3/2013
DE 10 2013 018 446 A1 10/2014
(Continued)

OTHER PUBLICATIONS

International Search Report and Written Opinion dated Jun. 18, 2021 in corresponding international application PCT/US2021/022097.

*Primary Examiner* — Jenna M Hopkins
(74) *Attorney, Agent, or Firm* — Leason Ellis LLP

(57) ABSTRACT

A frame-mounted mobile cleaning system permanently positionable above or below the tube bundles of an air-cooled heat exchanger (ACHE) and in fluid communication with an external source of pressurized cleaning fluid includes a mobile transverse spray head assembly formed from a plurality of separate interchangeable fluid compartments, each fluid compartment having an inlet for receiving the pressurized cleaning fluid and a fluid discharge wall having at least one nozzle aligned with the longitudinal axes of the finned heat exchange tubes below or above, or elongated slot nozzles that are transverse to the axes of the finned tubes and that are configured to discharge a predetermined pattern of pressurized cleaning fluid onto and between the surfaces of the fins of the heat exchange tubes as the assembly is moved from one end of the ACHE tube bundles to the other.

15 Claims, 9 Drawing Sheets

(51) Int. Cl.

| | |
|---|---|
| ***B05B 3/18*** | (2006.01) |
| ***F28F 1/10*** | (2006.01) |
| ***F28G 15/04*** | (2006.01) |
| ***F28G 1/16*** | (2006.01) |

(56) References Cited

U.S. PATENT DOCUMENTS 5,862,987 A * 1/1999 Reif ..... B05B 1/202 239/209
5,919,406 A * 7/1999 Bachofen ..... F24F 12/006 261/153
RE38,542 E * 7/2004 Ashton ..... F28G 3/16 122/392
7,624,470 B2 * 12/2009 Heyman ..... F28G 1/166 15/301
8,974,607 B2 * 3/2015 Al-Otaibi ..... F28G 1/166 134/166 R
9,334,788 B2 * 5/2016 Stone ..... F01P 11/06
9,573,077 B2 * 2/2017 Ruisinger ..... F28F 25/06
9,784,510 B2 * 10/2017 Al-Otaibi ..... F28G 1/166
10,018,431 B2 * 7/2018 Harkleroad ..... B05B 1/044
10,365,053 B2 * 7/2019 Billings ..... B05B 13/0278
10,907,914 B2 * 2/2021 Al-Otaibi ..... F28F 1/24
11,105,569 B2 * 8/2021 Pess ..... F28G 15/02
2008/0120802 A1 * 5/2008 Harvey ..... B05B 1/205 15/405
2014/0284027 A1 * 9/2014 Pozzie ..... F28D 1/0435 165/95
2014/0326280 A1 * 11/2014 Al-Otaibi ..... F28G 1/166 134/34
2017/0361358 A1 * 12/2017 Huettinger ..... B08B 3/042
2019/0293372 A1 * 9/2019 Hong ..... B05B 1/042
2020/0208928 A1 * 7/2020 Korth ..... B08B 3/02
2021/0254912 A1 * 8/2021 Stickling ..... F22B 37/48
2021/0291206 A1 * 9/2021 Al-Otaibi ..... F28G 15/04

FOREIGN PATENT DOCUMENTS

EP 3650793 A1 * 5/2020 ..... F28G 1/166
WO WO-2013020579 A1 * 2/2013 ..... F28G 9/00
WO 2013/101803 A2 7/2013

* cited by examiner

RECIPROCATING SPRAY CLEANING SYSTEM FOR AIR-COOLED HEAT EXCHANGERS

FIELD OF THE INVENTION

This disclosure relates to air-cooled heat exchangers and particularly to methods and permanently installed apparatus for removing accumulated dust and debris from the external surfaces of the projecting fins and the heat exchange tubes of an air-cooled heat exchanger (ACHE).

BACKGROUND AND PRIOR ART

Air-cooled heat exchangers are widely used in a variety of industrial facilities including large scale facilities for the production, treatment, storage and distribution of gas and liquid petroleum products. A typical ACHE of the prior art is illustrated in FIG. 1. The ACHE (10) includes a pair of headers (12A and 12B) that are joined by a plurality of finned heat exchange tubes positioned in a close array with the liquid heat exchange medium being pumped under pressure into inlet header (20) for circulation through the upper array of heat exchange tubes to the opposing header and then for returned flow through the lower heat exchange tubes for discharge through header outlet (22). This assembly is securely mounted in a robust housing (16) that is formed with upper flanges (26) positioned above the outer periphery of the upper array of tubes (18). The entire ACHE unit can be lifted into place and removed using lifting brackets (24). The ACHE is cooled by means of fans powered by variable speed electric motors. The fans positioned either above or below the unit with appropriate housings to maintain the directional airflow through the bundles of finned tubes.

In some installations, the ability to maintain continuous operation of the production units is dependent on the efficient operation of one or more ACHEs to reduce and control the temperature of process feedstreams within a prescribed temperature range in order to meet end product specifications and production goals. One measurable result of a reduction in the efficient heat transfer across the fins is an increase in power consumption associated with increasing the speed of the fans to accelerate the air flow through the ACHE in an effort to maintain the specified temperature reduction of the feed as it passes through the heat exchange tubes. This is particularly true in dry dusty environments where airborne dust and debris is introduced with the ambient air through the tube bundles and into contact with the surfaces of the cooling fins and accumulate within the tube-bundle which can quickly become coated with dust and collect dirt and debris that block the flow path and significantly reduces the rate of heat exchange compared to the original theoretical design specifications that generally specify a maximum outlet terminal temperature for the expected environmental conditions that is below the target temperature set by the process engineer. When the ACHE is fouled in a short period of time and its performance cannot be maintained by increasing the rate of air flow, more frequent and extensive cleaning is required.

A failure to properly maintain the efficient operation of ACHEs can lead to bottlenecks in production which can result in the interruption of downstream operations, the undesirable flaring of feedstreams, and significant financial losses. The above problems are multiplied when the ACHEs are in a desert or dusty environment as is often the case with natural gas and petroleum processing plants that are located in the vicinity of the sources of production.

Cleaning the outer surfaces and fins of the heat exchange tubes that make up the tube bundles of any type of ACHE presents a challenge because the majority of the rows of tubes forming the tube bundles are located beneath the upper and lowermost, or bottom rows, and because many tubes are packed into relatively compact configurations in order to minimize the overall space requirements for the installation of the units. Furthermore, the fins are necessarily thin to promote heat transfer efficiency and are susceptible to damage, e.g., if inadvertently impacted by manually directed cleaning equipment. For convenience, the term "tube bundle" as used in this description and claims will be understood to also include the plural form "tube bundles" when appropriate in the context of use.

One approach to the fouling problem of ACHE heat exchange tube fins is described in U.S. Pat. No. 8,974,607 in which a portable cleaning apparatus that is formed as a generally planar spray mat is positioned horizontally between the vertically spaced rows of heat exchange tubes and a pressurized cleaning fluid is distributed generally laterally through channels formed within the mat and is discharged outwardly away from the surface of the mat through spray nozzles onto the adjacent heat transfer fins. A second imperviously mat is positioned below the ACHE to collect and drain the used cleaning fluid for removal from the site. The system and method of the '607 patent requires personnel to position the mat between the rows of finned spray tubes which must be done with great care in order to avoid damaging the fins and the spray mat. The ACHE must be shut down during cleaning, which is another disadvantage of the method.

U.S. Pat. No. 5,279,357, a permanently installed cleaning system is described that is positioned above and between the tube bundles and employs a series of horizontal stationary tubes fitted with nozzles or spray arms that rotate about a central axis to discharge the pressurized cleaning fluid through spray nozzles onto the adjacent fins. The ACHE must be especially designed and constructed with sufficient vertical spacing between the horizontal rows of tubes to accommodate the numerous pipes and nozzles and/or the rotating spray arms.

A temporary cleaning system is described in U.S. Pat. No. 4,141,754 for use with a specialized plate heat exchanger that is known as a rotary regenerative heat exchanger which is constructed with vertical plates mounted inside an exterior enclosure. The method of the '754 patent includes the disadvantages of having to shut down the heat exchanger, dismantle and remove the enclosure, and then install the temporary cleaning system. A pair of C-channels are positioned horizontally above the plates to form parallel tracks extending along a major axis, which cover only a portion of the width of the unit. A wheeled cleaning carriage is positioned to move along the length of the C-channels in response to a motor driven system via a pair of ropes attached to a take-up drum and the cleaning carriage. As illustrated, the cleaning fluid is delivered via a reciprocating conduit having discharge ports positioned in fluid communication with vertical conduits corresponding to the nozzles below the carriage surface. This system of the '754 patent thus suffers the disadvantages of (1) shutting down the operation of the heat exchange unit which necessitates the presence of a back-up unit operating in parallel, (2) the need to temporarily install the tracks, motor-driven cable system, and the cleaning fluid delivery conduits, and (3) the need to disassemble and move the apparatus in order to clean the entire area of the heat exchange plates.

Various types and configurations of portable spray cleaning apparatus that are temporarily put into position for the purpose of removing dirt and debris that has fouled and reduced the efficiency of an ACHE are known in the art. These various systems suffer from the disadvantages of (1) shutting down the operation of the ACHE in order to carry out the cleaning, (2) the need to temporarily install the elements of the cleaning system, and the cleaning fluid delivery conduits, and (3) the need to disassemble and move the apparatus once the cleaning operation has been completed.

A need exists for an automated online cleaning system for use with a wide variety of air-cooled heat exchangers that overcomes the following problems:

1. Providing a cleaning system that is permanently installed above and in close proximity to the ACHE above the tube-bundle and that can be activated at any time during the operation of the ACHE on an "as needed" basis to restore operational efficiency in order to assure that product specifications of temperature and through-put are met.
2. Providing a system that extends across the entire width of the tube bundles comprising the ACHE so that the cleaning step can be completed quickly and without operational interruption.
3. Providing a cleaning system that can be configured to retrofit existing ACHE units of various dimensions by the use of interchangeable components that can be assembled to the desired size.
4. Providing a system that is configured to deliver a uniform quantity of pressurized cleaning fluid across the entire width and length of the ACHE at a predetermined pressure and flow rate throughout a cleaning cycle.
5. Providing a system that can be installed and made operable without significant structural modifications to the underlying ACHE and/or its housing or internal structure.
6. Providing a system that is robust and capable of essentially continuous operation under adverse atmospheric conditions including high temperatures, i.e., in excess of about 120° F./50° C., and high concentrations of airborne dust and debris to which the ACHE is exposed.
7. Providing a system in which the mobile spray head assembly is movable to a position displaced from the region above or below the tube bundles in order to permit the free flow of the cooling air across all of the heat exchange fins and tubes of the ACHE.

SUMMARY OF THE INVENTION

The above problems are addressed and other advantages are achieved in accordance with the present disclosure by an ACHE cleaning system and method in which a mobile frame-mounted cleaning apparatus is permanently positioned in spaced-apart relation above the uppermost tube bundle or below the lowermost tube bundle of an ACHE and configured for reciprocating movement on tracks secured to the ACHE side walls, or housing, that are parallel to the longitudinal axes of the tubes constituting the bundles.

The apparatus includes a transversely mounted spray head assembly comprised of a plurality of interchangeable fluid compartments that are securely positioned on, and carried by a reciprocating supporting frame that spans the width of the opening either above or below the tube bundles.

In an embodiment, each fluid compartment has an inlet for admitting a pressurized cleaning fluid, and the spray head assembly includes a fluid distribution manifold that is configured with a plurality of fluid discharge tubes or conduits with fluid-tight fittings that are in fluid communication with the inlets to the fluid compartments. The manifold receives pressurized cleaning fluid via a manifold inlet from an external source. The surface of each of the fluid compartments proximate the tube bundles is provided with at least one, but preferably a plurality of spray nozzles through which the pressurized cleaning fluid is discharged either downwardly in an embodiment in which the assembly travels above the tube bundles, or upwardly from below onto and between the finned heat exchange tubes in the embodiment in which the spray head assembly travels below the ACHE.

In a preferred embodiment, at least a portion of the spray nozzles are configured to discharge a generally elongated high-pressure spray pattern e.g., in the range of from 500 to 1500 psi, in order to maximize the amount of cleaning fluid impinging on the finned tubes while also avoiding any damage to the fins due to high pressure fluid impingement.

The individual fluid compartments are preferably dimensioned and configured to be of uniform height and depth, and of predetermined varied widths so that the total width of an assembly comprised of a plurality of fluid compartments can be varied within a predetermined range to span ACHE units of different widths. For example, if the width of an ACHE to be fitted with the cleaning system of this disclosure is 8.75 feet, the assembly can be configured with eight so-called standard width "W" compartments that are each one foot wide, one six-inch wide compartment, i.e., "½ W", and one compartment that is three inches wide, or "¼ W", to make up the total of 8.75 feet. Other intermediate widths can be employed as determined by the size and weight of the fluid compartments, and their transportability.

In an embodiment, the individual fluid compartments have side walls that are configured for engagement with adjacent compartments to form a rigid unitary structure that can be extended to span the width of the open area of the ACHE above the finned tubes. The opposite sides of each fluid compartment can include a surface that is provided with a plurality of projecting lugs and corresponding recesses that from matching patterns so that the designated right side surface of each compartment will mate with the left side surface of an adjacent compartment forming the assembly.

In an embodiment, the individual fluid compartments have side walls that are adapted to pass and/or receive pressurized cleaning fluid from at least one adjacent fluid compartment via a fluid passage that includes a resilient, compressible or otherwise movable fitting that is configured and dimensioned to engage in fluid-tight relation with a corresponding fitting in the side wall of an adjacent fluid compartment in which it is mounted. In an embodiment, the fluid passage is circular and the fitting is an annular member that is assembled in close-fitting fluid-tight relation with the side wall of the fluid compartment in which it is mounted. The annular member can be formed, e.g., by molding, from a durable resilient material such as neoprene in a generally cylindrical shape and provided with integrally molded flanges at either end, the longitudinal distance between the inside edges or faces of the flanges corresponding to the thickness of the compartment walls in which the annular member is to be mounted. The end of the annular seal that is inserted through the exterior wall of the fluid compartment is denominated the interior flange and is dimensioned and configured to undergo compression deformation to permit it to be press-fitted through the opening in the compartment side wall and rebound to its original shape in order to not only retain the annular seal securely in place, but also to provide a fluid-tight seal with the wall. The design, dimensioning and selection of materials of construction of the annular seals are within the skill of the art.

The end of the annular fitting opposite the interior flange has an outwardly facing surface that is configured to mate in fluid-tight sealing relation with the appropriately configured corresponding surface of an annular fitting secured in the side wall of an adjacent fluid compartment. The opposing surfaces of the facing sealing flanges are urged into sealing relation as a result of a predetermined lateral force applied to the plurality of aligned fluid compartments that form the assembly spanning the width of the ACHE opening above and adjacent the tube bundles, when the assembly is put in place on a transverse supporting frame that reciprocates on the tracks secured to the ACHE housing side walls that extend parallel to the longitudinal axes of the tubes.

In an embodiment, the supporting frame preferably includes vertical retaining end walls or other members at either end that are dimensioned and configured to maintain the fluid compartment assembly in place and prevent its lateral, or transverse movement. At least one of the vertical end wall retaining members can include a mechanism for adjustably applying a lateral force to the side wall of the adjacent fluid compartment in order to secure the entire assembly of fluid compartments in close-fitting relation. In the embodiment described above, the application of a lateral force brings the adjacent annular seal members into fluid-tight sealing relation so that a pressurized cleaning solution introduced into one fluid compartment via an inlet fitting, e.g., mounted into the top wall of the compartment will be transmitted to all adjacent compartments. The mechanism for adjustable applying a lateral force can be a lever-activated ratchet, either circular or linear, a manual or hydraulically actuated screw assembly, or a hydraulic ram or piston.

It will be understood that the manifold described above is not required where the fluid compartments comprising the assembly are in fluid communication with each other. Instead, a single conduit can be employed to introduce the pressurized fluid into an inlet of one compartment via a single fluid-tight fitting.

Each compartment is fitted with one or more cleaning spray nozzles the size and the spray characteristics of each are selected based on the tube bundle arrangement and configuration of a specific ACHE. Each of the fluid compartments has a fluid discharge wall that is provided with at least one, but preferably a plurality of nozzles for discharging the pressurized cleaning fluid in one or more predetermined spray patterns. The nozzles are spaced-apart transversely and, optionally, longitudinally. In an embodiment, the nozzles are aligned along a diagonal, and each nozzle is centrally aligned with the finned heat exchange tubes over which the spray head passes when the cleaning system is in operation.

In the description that follows, it will be understood that the term "nozzle" can refer to a point source nozzle where the cleaning and/or drying fluid is discharged from one orifice, or a slot nozzle in which the fluid discharge opening is elongated and relatively narrow as compared to its length.

The nozzles can be integrally formed in the fluid discharge wall or other surface of the compartment that moves proximate the heat exchange tubes by molding, cutting and/or drilling the openings. Alternatively, individual spray nozzles can be fitted to outlet openings in the bottom wall or lower portion of the compartments, e.g., by conventional threaded fittings, snap-fittings, frictional fittings, or the like.

The fluid compartments can be fabricated from metal sheets or rolls, and in a preferred embodiment are rotationally molded from polyethylene and/or other copolymers to provide a chemically resistant, highly durably container with high impact strength that can be worked with conventional tools to provide openings for mounting of fittings, nozzles, seals and the like, and is relatively lightweight to facilitate manual handling. The individual fluid compartments can be provided with integrally-molded handles and/or hand-holds for this purpose.

The mobile supporting frame is self-supporting and is comprised of securely assembled I-beams or L-beams, or channels, and is reinforced to form a rigid structure to withstand the dynamic loading of the filled fluid compartments during reciprocation. The support frame is dimensioned and configured to securely receive and retain a plurality of removable fluid compartments of varying widths and sizes.

Various arrangements of tracks, guide rails, pulleys, cables and electric motors can be utilized to move the mobile supporting frame from one end of the opening of the ACHE above or below the finned tube array. The cleaning system's mobile supporting frame and fluid compartments are preferably stored when not in use at one end of the ACHE under a protective cover that will shield the apparatus from contamination by the same dust and debris which must be cleaned from the finned tubes.

The embodiment in which the cleaning system is mounted below the tube bundles and the pressurized cleaning fluid is sprayed upwardly through the finned tubes has the advantage of providing a dual cleaning action as the pressurized fluid moves upwardly through the tubes and then drains downwardly under the effect of gravity.

DETAILED DESCRIPTION OF THE PREFERRED EMBODIMENTS

Figure 1:
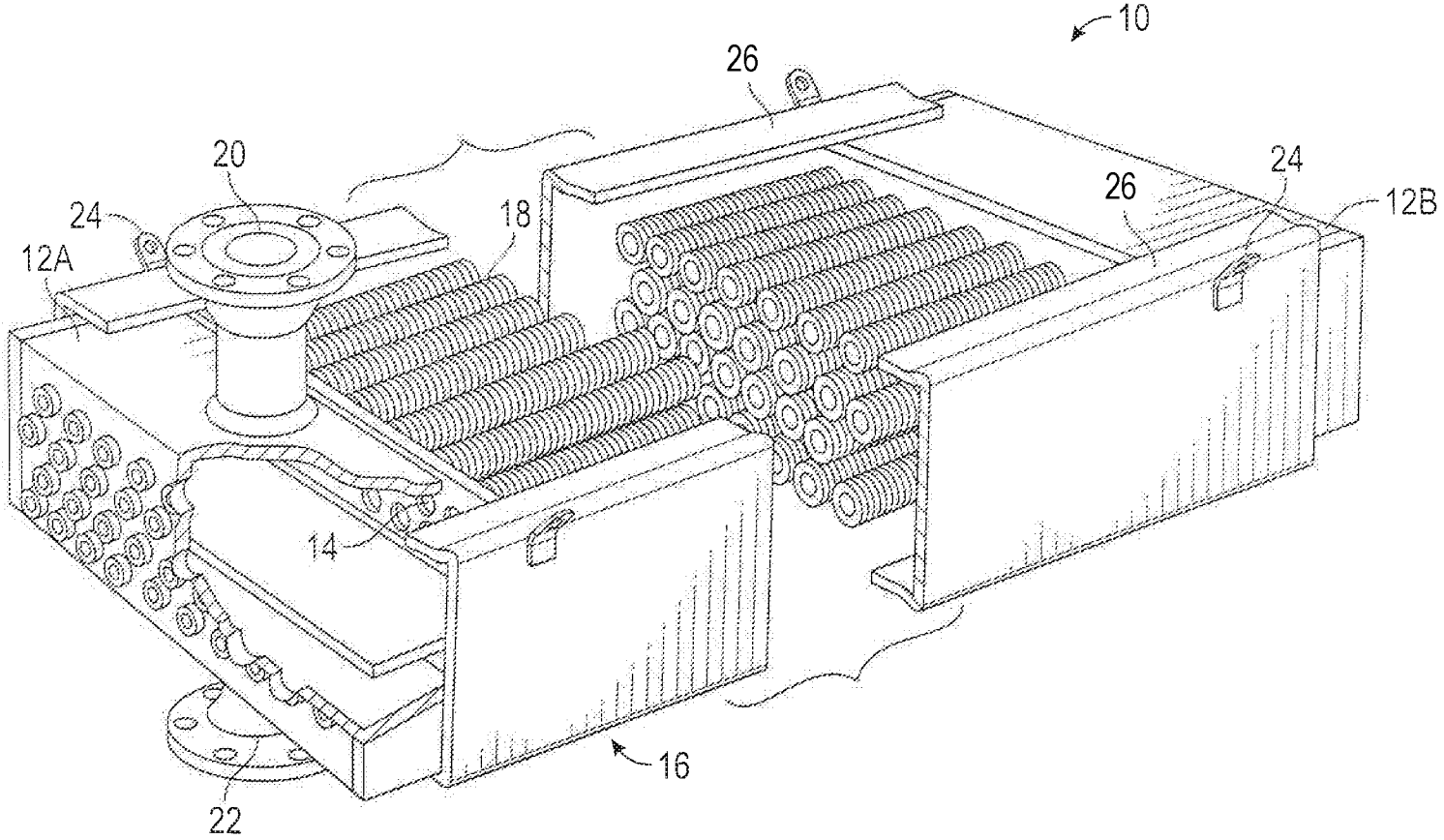
FIG. 1 (Prior Art)
FIG. 1 is a top, front and right side perspective view of a conventional prior art air-cooled heat exchanger (ACHE) that includes an inlet header, outlet or return header and heat exchange tubes in a housing.
Figure 2A:
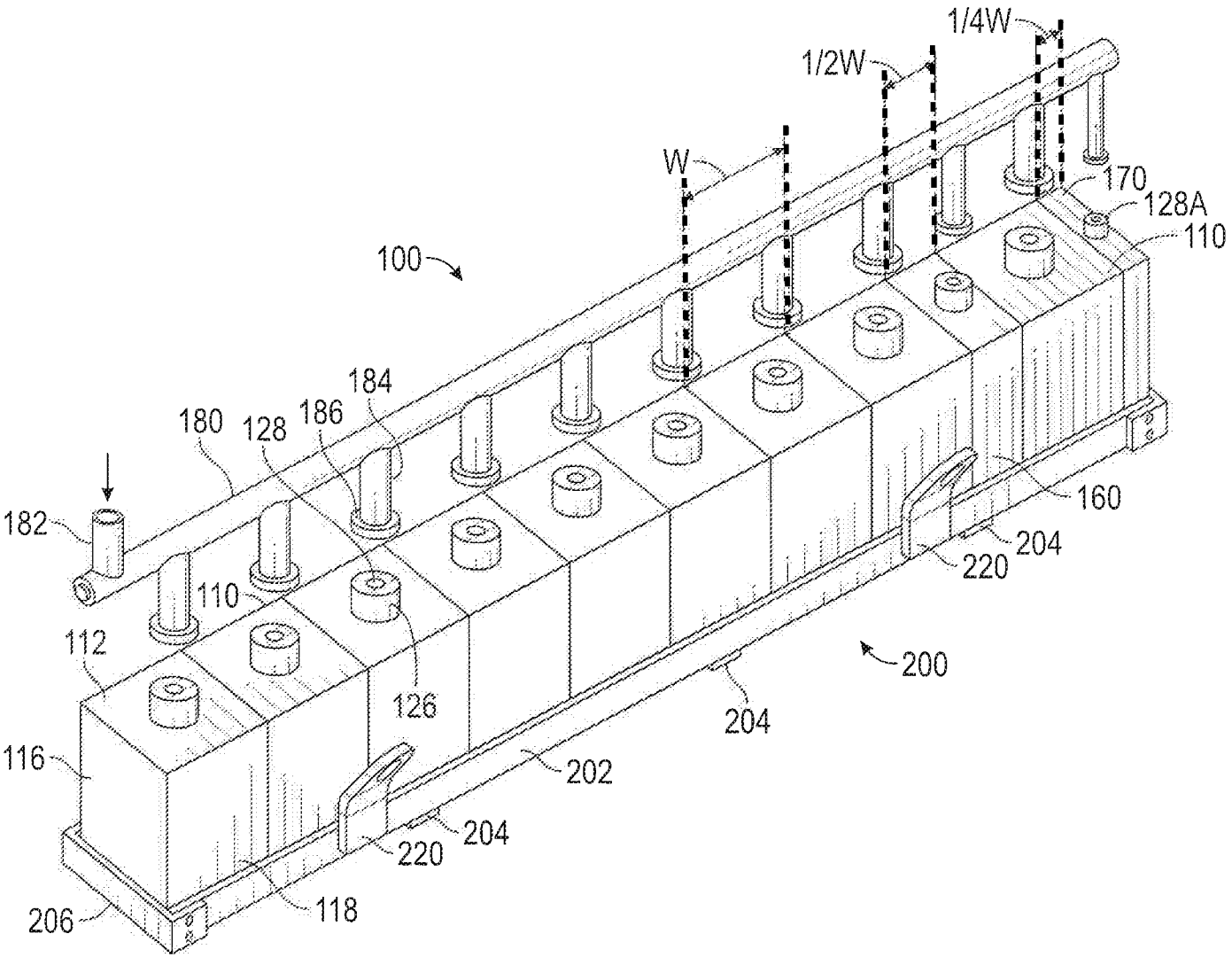
FIG. 2A is a top, front and left end perspective view of an embodiment of a spray head assembly.

Referring now to FIG. 2, a spray head assembly (100) is comprised of a plurality of close-fitting rectilinear fluid compartments which are securely retained in a supporting frame (200) of a predetermined transverse width that extends across the upper surface of the finned heat exchange tube bundles (18) of the ACHE for which the spray head assembly is intended for use. The supporting frame (200) can advantageously be constructed from a pair of parallel L-shaped longitudinal members formed of steel that are linked at spaced-apart locations by a plurality of steel cross members (204) to provide a rigid construction. The ends of the longitudinal members (202) are secured together by transverse end members (206) which can be joined by any convenient means, including welding, threaded fasteners, rivets and the like. In order to provide means for lifting the supporting frame into position, at least two lifting brackets (220) each having a bracket opening (222) are secured to the exterior vertical surfaces of the opposing longitudinal members (202). As shown in FIG. 2A, the upper or free end of the lifting brackets (220) extend outwardly from the respective longitudinal members to which they are attached and from the fluid compartments placed in the supporting frame in order to permit hooks or other lifting devices to be placed in the bracket openings (222).

In a preferred embodiment, the supporting frame (200) is provided with a plurality of fluid compartments (110), which are preferably of a uniform configuration and a width "W" to minimize inventory requirements. In order to accommodate ACHE units of different sizes and widths, e.g., that are not an even multiple of the fluid compartment, such as 10 times W, fluid compartments of ½ W (160) and ¼ W (170) are maintained in inventory to complete the spray head assembly and provide complete coverage of the tube bundles.

With continuing reference to FIG. 2A, each of the standard size fluid compartments (110) and, if required for a particular ACHE, the smaller compartments (160, 170) is provided with an inlet fitting (128) that is received in an inlet port (126) that is provided in the top wall (112) of each of the compartments. As will be understood, the relatively smaller fluid compartments (160, 170) if required can be provided with inlet ports and inlet fittings that are proportionally smaller than those of the fluid compartments of the standard width W. However, to the extent possible, all parts and fittings, including the compartments, should be standardized for the reasons explained above. As will be understood by those skilled in the art, it is desirable to use standardized parts and fittings in the construction of the various components making up the assembly in order to minimize the types and sizes of spare parts that must be kept available for repairs and replacement during the life of the system.

Positioned above the fluid compartments comprising the spray head assembly (100) is a fluid distribution manifold (180) that in the particular embodiment illustrated includes a manifold inlet (182) and a plurality of depending manifold discharge tubes (184), the free ends of which are each provided with fluid-tight fittings (186) that are configured and dimensioned to engage the inlet fittings (128) of the fluid compartments below. As illustrated, it will be understood that the manifold fittings that engage fluid compartments (160, 170) of narrower widths may be proportionally scaled to provide the required fluid-tight fitting when the pressurized fluid is introduced into manifold inlet (182) from an external source (not shown).

For the purposes of illustration, the manifold discharge tubes (182) appear as rigid conduits. However, it will be understood by those of ordinary skill in the art that the manifold discharge tubes can be configured as flexible hoses with appropriate fluid-tight fittings (186) attached, e.g., by clamps or other known means.

Any of various known types of fluid-tight fittings, such as quick-release hose fittings, can be used to couple the discharge manifold fittings (186) to the inlet fitting (128) of the fluid compartment to assure a fluid-tight coupling. The use of a flexible conduit for the manifold discharge tube (186) is desirable, since the manifold (180) will have to be attached and removed when the spray head assembly (100) and its supporting frame (200) are moved, e.g., initially placed for use on the ACHE and then removed for any eventual servicing of the unit. This manual task will be greatly facilitated by the use of quick-release couplings.

The fluid compartments (110) illustrated in FIG. 2A are described in more detail with reference to FIGS. 3A and 3B which are views from two opposing sides (118 and 120) of an embodiment of the fluid compartment suitable for use in this disclosure. A suitable inlet fitting (128) is positioned above the inlet port (126) which as shown, are conventionally threaded. In an alternative, the parts can be coupled using a bayonet-type attachment, which can include a washer between the flange of the fitting and the top surface (112) of the fluid compartment (110). As will be understood by one of ordinary skill in the art, any of other well known arrangements for securing the fitting to the compartment can be substituted to effect a fluid-tight coupling.

In a preferred embodiment of the system and apparatus, the close-fitting relationship and alignment of the compartments (110) on the frame is achieved by maintaining the dimensional tolerances during the manufacture of the compartments and of the assembly of the supporting frame (200) as described above. As is described in more detail below and in conjunction with FIG. 6, at least one end of supporting frame (200) is provided with an adjustable compression system or device for applying a compressive force to the aligned compartments (110) to securely maintain them in position during the cleaning operation.

Figure 3A:
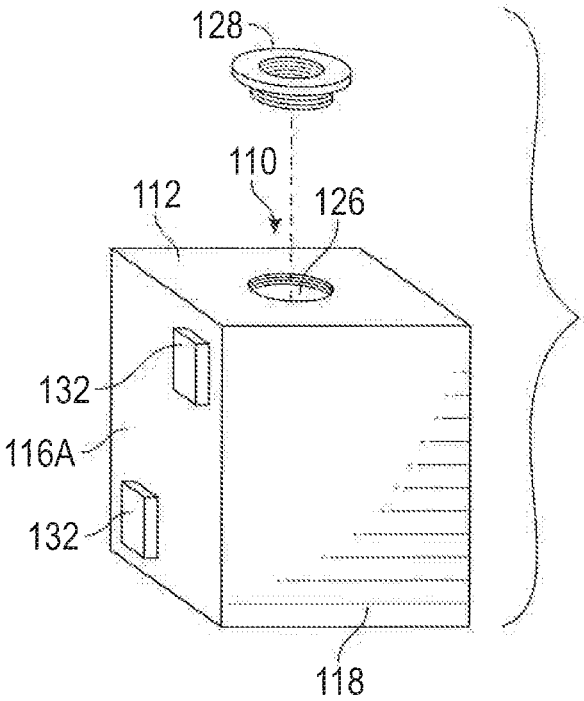
FIG. 3A is a top, front and left side exploded perspective view of an embodiment of a top-filling fluid compartment for use in the spray head assembly of FIG. 2A.
Figure 3B:
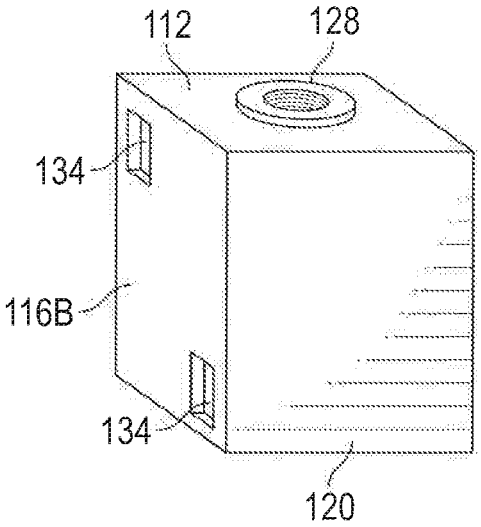
FIG. 3B is a view similar to FIG. 3A showing the right side of the compartments.

In an alternative embodiment shown in FIGS. 3A and 3B, the side wall (116A) can optionally be provided with projecting lugs (132) which will engage with recesses (134) in opposing side wall (116B) to assist in maintaining adjacent fluid compartments in secure alignment when placed in the supporting frame (200). Any other arrangement of interlocking elements on the opposing external faces of the fluid compartments can optionally be employed to achieve the desired result of maintaining the adjacent fluid compartments in alignment. This arrangement is particularly adapted for use when the individual compartments are produced using a corrosion resistant material, such as by molding of polymeric compositions, e.g., in a rotary mold using powdered polymer, which will provide compartments that are not subject to chemically-induced corrosion and/or fouling by airborne dust and debris. As shown in FIG. 2A, a fluid compartment (110) on an end of the assembly (100) can incorporate a blank side wall (116) without projecting lugs (132) or recesses (134).

Figure 3C:
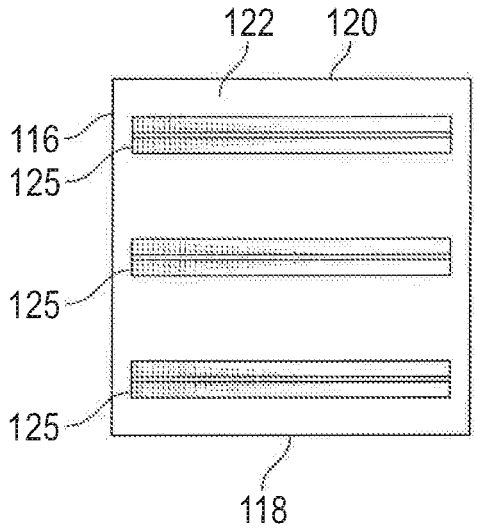
FIG. 3C is a bottom view of the fluid compartment of FIGS. 3A and 3B that includes three transverse slot nozzles.

Referring to an alternative embodiment illustratively depicted in FIG. 3C, the bottom wall of the compartment (122) is provided with an array of three spaced-apart slot nozzles (125) that extend transverse to the axis of the ACHE finned tubes. In the embodiment shown, the three slot nozzles in effect triple the number of cleaning fluid sprays that impinge on the fins and tubes below. The spray slots can be chamfered, either inwardly so that the slot is narrower at the outlet, or outwardly flared.

The patterns of the slot nozzles can be varied for a single compartment. The pattern and force of the spray discharged from the slot nozzles can also be varied by changing the pressure of the cleaning fluid supplied to the system. This variable can be determined by the operator based on experience, and can be dependent on a number of variable factors, such as the type and extent of fouling on the fins, the interval(s) between cleaning, the type and temperature of the cleaning fluid(s) and the like.

In the embodiment of FIG. 3C, the slot nozzles can be integrally formed in the bottom wall of the compartment at the time of molding, or drilled and/or machined into the desired configuration to achieve the predetermined spray pattern for the molded unit. The same methods can be applied to forming integral single-point nozzles. These methods are well within the skill of the art and will not be described further.

Figure 3D:
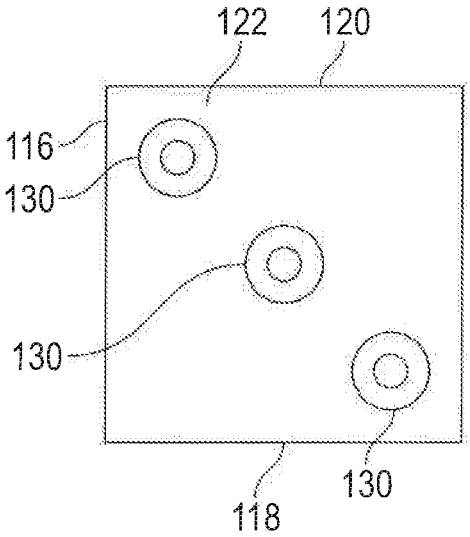
FIG. 3D is an alternative embodiment of FIG. 3C in which three spray nozzles are fitted in a diagonal array in the bottom wall of a fluid compartment.
Figure 3E:
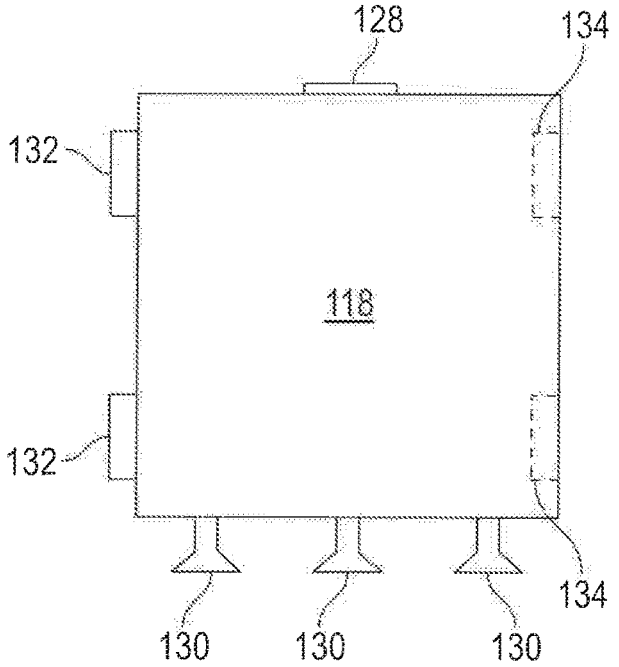
FIG. 3E is a rear elevation of the fluid compartment of FIGS. 3A and 3B in which three nozzles extend from the bottom wall.

Referring now to FIGS. 3D and 3E, the bottom and side views, respectively of the compartment illustrated in FIGS. 3A, 3B, three spray nozzles (130) are shown extending in a diagonal array across the bottom wall (122) of the fluid compartment. In operation, a pressurized cleaning fluid is admitted into the compartment via inlet fitting (128) and discharged through the plurality of spray nozzles (130), the positions of which are predetermined to align with the finned tubes as the unit is transported down the ACHE. The spray pattern discharged by the nozzles (130) can be the same or different and can be selected to provide a wide area of spray, e.g., circular, oval and/or elongated, emitted from one or more of the plurality of nozzles in order to achieve the efficient cleaning of dirt and debris from the fins and the tubes of the tube bundles making up the array of the ACHE. The projecting lugs (132) and the corresponding recesses (134) described above are also shown in FIG. 3E.

The slots can be of the same width and the nozzle exits can be of the same or of different configurations. For example, the opposing interior side walls of the slot nozzle can be parallel or slanted so that the discharge edge is either narrower than the compartment or intake side, or wider along the discharge edge to produce different spray patterns. Two or more different configurations can be used for the slots in a single compartment.

As will be understood by one of ordinary skill in the art that the number of slots can be greater, or less, than three, e.g., a total of four or five slots. Factors such as the availability, volume, pressure and temperature of the cleaning fluid discharged on the finned tubes, as well as the type and amount of accumulated dirt and debris on the finned tubes will effect the design criteria of the present system.

It will also be understood by one of ordinary skill in the art, the dimensions of the generally rectilinear compartments are not critical. In the interests of clarity and ease of description, the compartments shown in the attached drawings, with the exception of FIGS. 5A-5C described below, are depicted as being generally cubical to accommodate the various fittings in a scale that will facilitate a clear understanding of the structure.

Figure 5A:
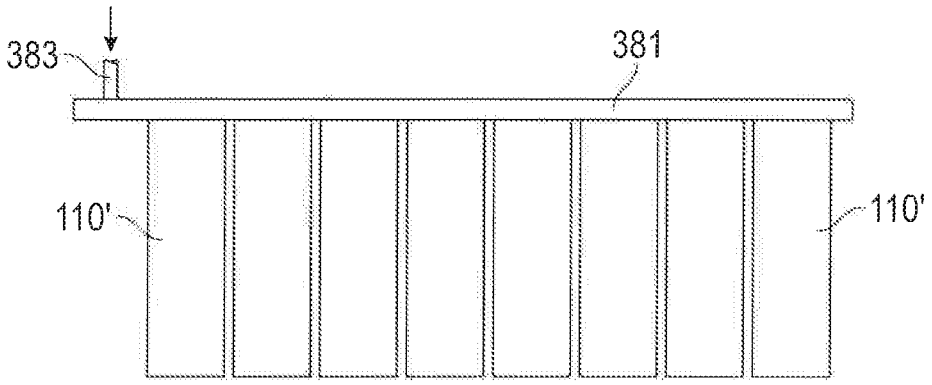
FIG. 5A is a front elevation view of another embodiment of a group of fluid compartments depending from a horizontal cleaning fluid delivery conduit.
Figure 5B:
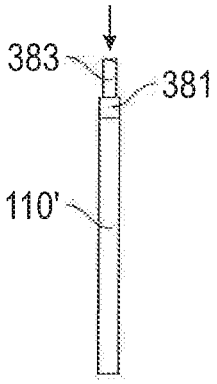
FIG. 5B is an end view of the compartments of FIG. 5A.
Figure 5C:
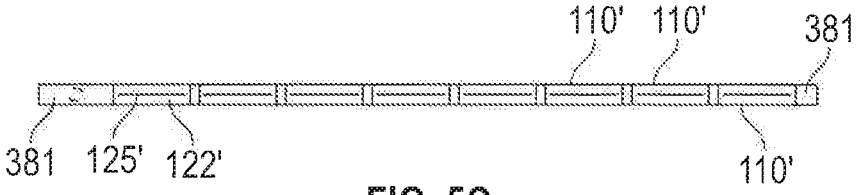
FIG. 5C is a bottom view of the compartments of FIG. 5A.

An alternative embodiment, for example, is schematically illustrated in FIGS. 5A, 5B, and 5C where each of the pressurized fluid compartments (110') is relatively narrower in the dimension that corresponds to the axis of the finned tubes. Alternatively, one or more of the compartments can contain multiple internal fluid channels that terminate in, and define an individual slot (not shown). Each of the channels can include internal reinforcing supports extending between the opposing vertical walls to produce a robust construction. In an embodiment, the internal supporting walls are dimensioned and configured proximate the nozzle outlet to directionally dispose the cleaning fluid towards the tubes below. As best shown in FIGS. 5A and 5B, the compartments (110') are in fluid communication with a rectangular manifold of the cleaning fluid delivery conduit (381) sealed at its ends and fitted with an inlet tube (383) through which pressurized cleaning fluid is admitted, e.g., as is shown and described in more detail in connection with FIGS. 2A and 2B. Referring to the bottom view of FIG. 5C, the bottom wall (122') of each compartment (110') is provided with a slot nozzle (125') dimensioned and configured to discharge a spray onto the finned tubes.

Figure 2B:
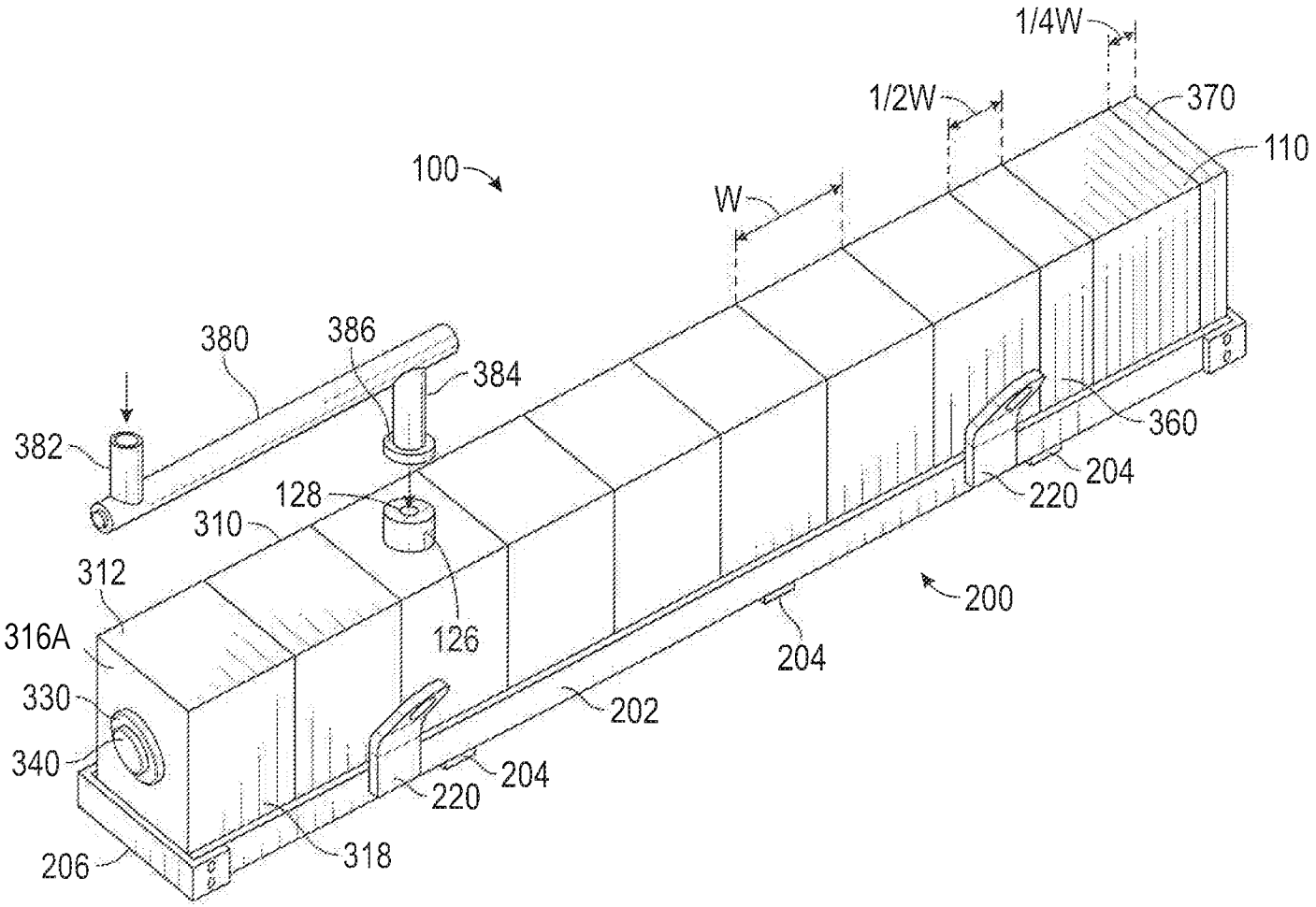
FIG. 2B is a top, front and left end perspective view of another embodiment of a spray head assembly in accordance with this disclosure.
Figure 4A:
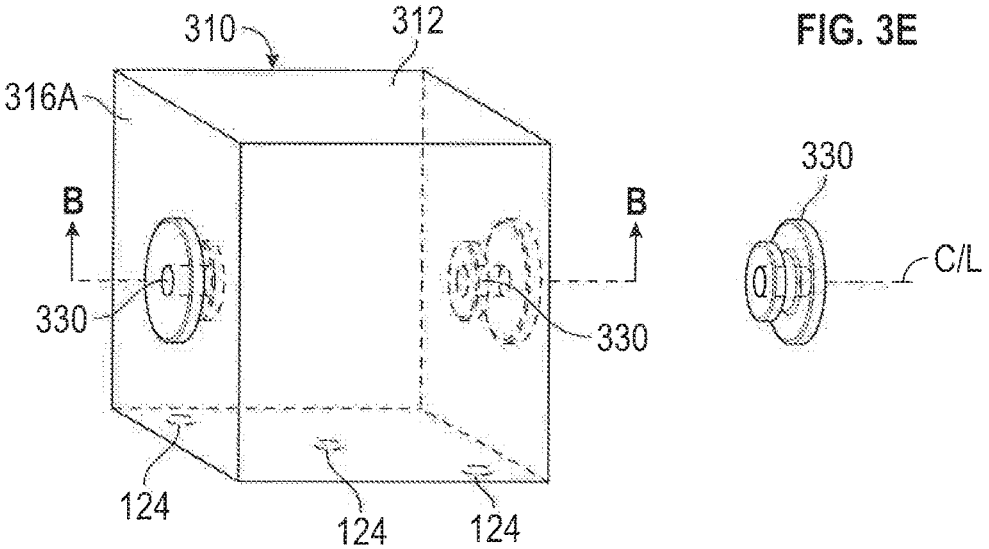
FIG. 4A is a top, front, left side perspective view of another embodiment of a fluid compartment with side wall fluid passageways.
Figure 4B:
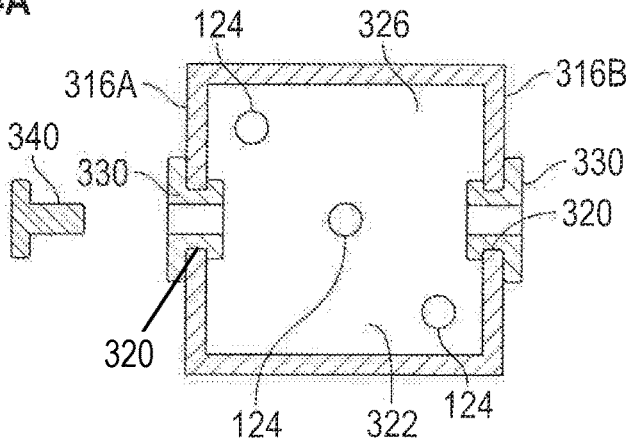
FIG. 4B is a top sectional view of the fluid compartment of FIG. 4A taken along section line B-B.

Another embodiment of the spray head assembly (100) for use in the system of the present disclosure will be described with reference to FIGS. 2B, 4A, and 4B. The top wall (312) and side (318) of fluid compartment 310 illustrated in FIG. 2B correspond in arrangement to top wall (112) and side (118) of the embodiment illustrated in FIGS. 2A, 3A, and 3B. In this arrangement, each of the fluid compartments (310, 360, 370) are provided with fluid passages (320) in opposing side walls (316A, 316B) that are aligned so that each of the plurality of fluid compartments shown in FIG. 2B have transversely aligned passages throughout the width of the supporting frame (200). Referring specifically to FIGS. 4A, 4B, a resilient annular seal (330) is shown positioned in the opposing passages (320). The annular seals are dimensioned and configured and are sufficiently resilient to deform and provide a fluid-tight seal when brought into a compressed relation with the seal of an adjacent compartment. The annular seals in the external walls of the fluid compartments at either end of the spray head assembly (100) are fitted with a resilient sealing plug (340) to maintain a seal against the pressurized fluid during use of the unit. The sealing plug (340) can be configured in accordance with methods well known in the art to assure that it is retained in place and maintains a fluid-tight seal when the assembly is pressurized with cleaning fluid—for example, in the interior chamber (326) of fluid compartment (310). The annular seals (330) can advantageously be of a molded silicone polymer that is chemically resistant and not subject to oxidation or other forms of deterioration which lead to a loss of resiliency.

In an embodiment (not shown), the exterior side wall of the compartment (310) is recessed a predetermined amount to receive the exterior peripheral portion of the annular seal (330) during deformation to permit the facing exterior walls of the fluid compartments to be brought into touching relation. The interior flange of the annular seal is preferably dimensioned and configured to permit its deformation during insertion through the side wall passage (320) and then to return to its original configuration in order to provide the interior seal to retain the pressurized fluid.

The fluid compartment (310) is provided with a plurality of openings (124) in the bottom wall (322) adapted to receive nozzles as described above in connection with FIG. 2A. It will also be understood that any minor fluid leakage between the annular seals (330) will not result in a significant drop in the fluid pressure and that the pressurized discharge from the cleaning nozzles will be maintained at a sufficient level to accomplish the desired degree of the cleaning of the fins and the tubes.

Returning to FIG. 2B, a simplified manifold or charging conduit (380) comprises a manifold inlet (382), manifold outlet (384) and fluid-tight fitting (386). It will be understood from the above description of the fluid compartments (310) and their interconnecting fluid passages that only a single compartment inlet fitting (128) is required to pressurize all of the compartments in the spray head assembly.

Referring now to the partially exploded view of the supporting frame (200), one embodiment of its construction is illustrated. It will be understood that the structural elements are fabricated from an appropriate gauge of steel or stainless steel to provide a sufficiently robust structure to support the fluid compartments which carry clean fluid to their capacity during the spray cleaning operation, and that the entire unit will be subject to additional stresses during reciprocating movement. The elements can be joined by welding, by threaded fasteners, rivets, either alone or in combination.

An embodiment illustrating the installation of a spray head assembly (100) in accordance with FIG. 2B on a supporting frame (200) placed on a reciprocating wheeled carriage (500) will be described with reference to FIGS. 7 and 8. The wheeled carriage (500) is constructed from transverse carriage members (502) securely joined to longitudinal carriage members (504) which include structural members supporting a pair of wheels (510) at either side of the carriage. A pair of tracks (520) are secured to the upper surface of flange (22) extending horizontally from the side walls (16) forming the housing of the ACHE.

A drive assembly positioned at an end of the ACHE that is preferably opposite the inlet and outlet headers includes an electric drive motor (560), a motor controller (562), a power supply (564) and a gear reducer (550). Drive shafts (552) extend from the gear reducer and are fitted with drive pulleys (540) that engage drive cables (530) attached to the transverse carriage member (502), or other suitable structural member of the carriage. The drive cables (530) can be of braided stainless steel construction or can take the form of a chain in which the pulleys are sprockets adapted to receive the chain in order to provide a more controlled movement and avoid any possible slipping of the pulley on a wet metal cable.

Figure 7:
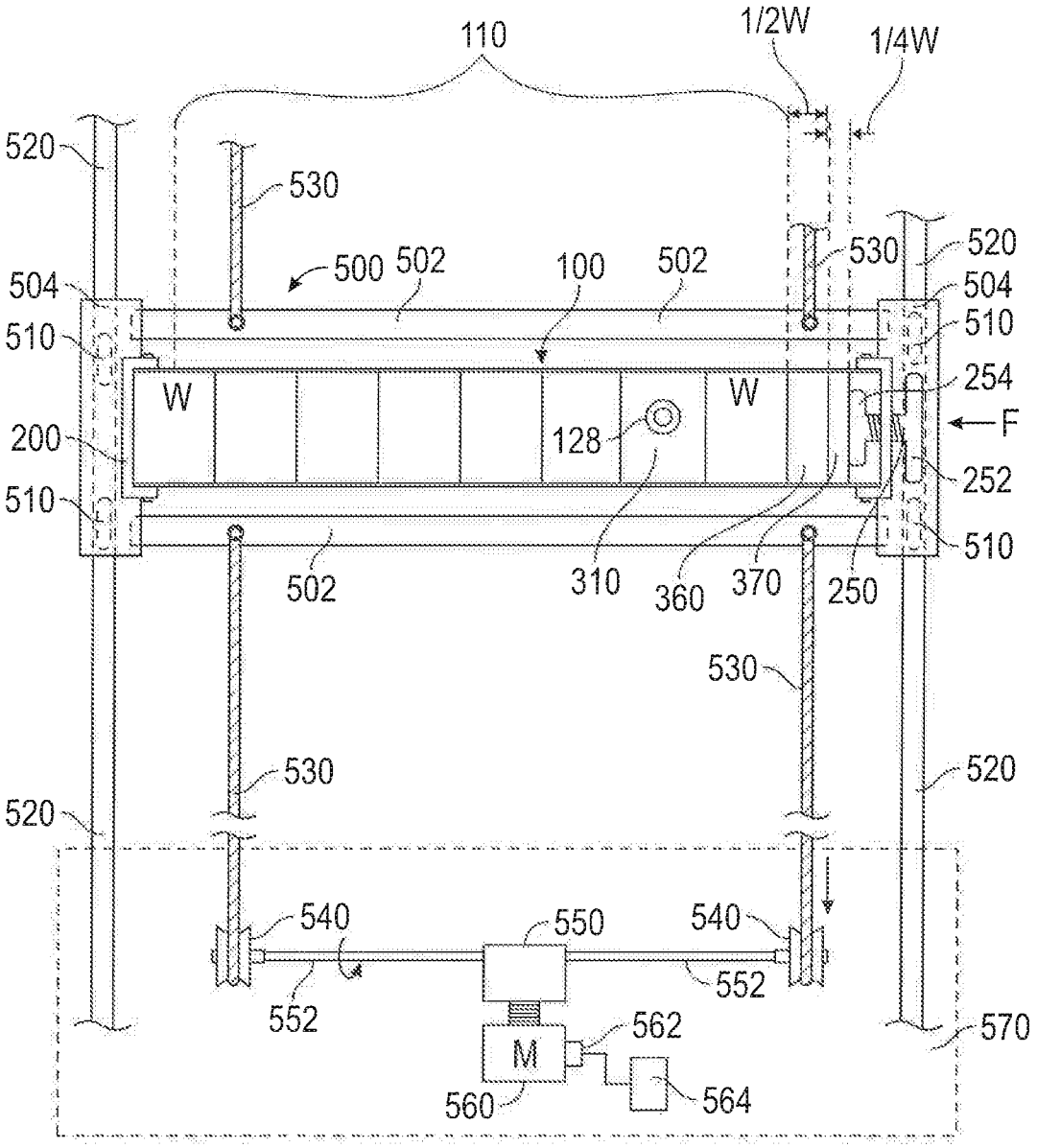
FIG. 7 is a top view, partly in phantom showing a portion of an ACHE fitted with the spray head assembly of FIG. 2B mounted on a mobile carriage connected to drive means for reciprocal movement to clean the finned heat exchange tubes.
Figure 8:
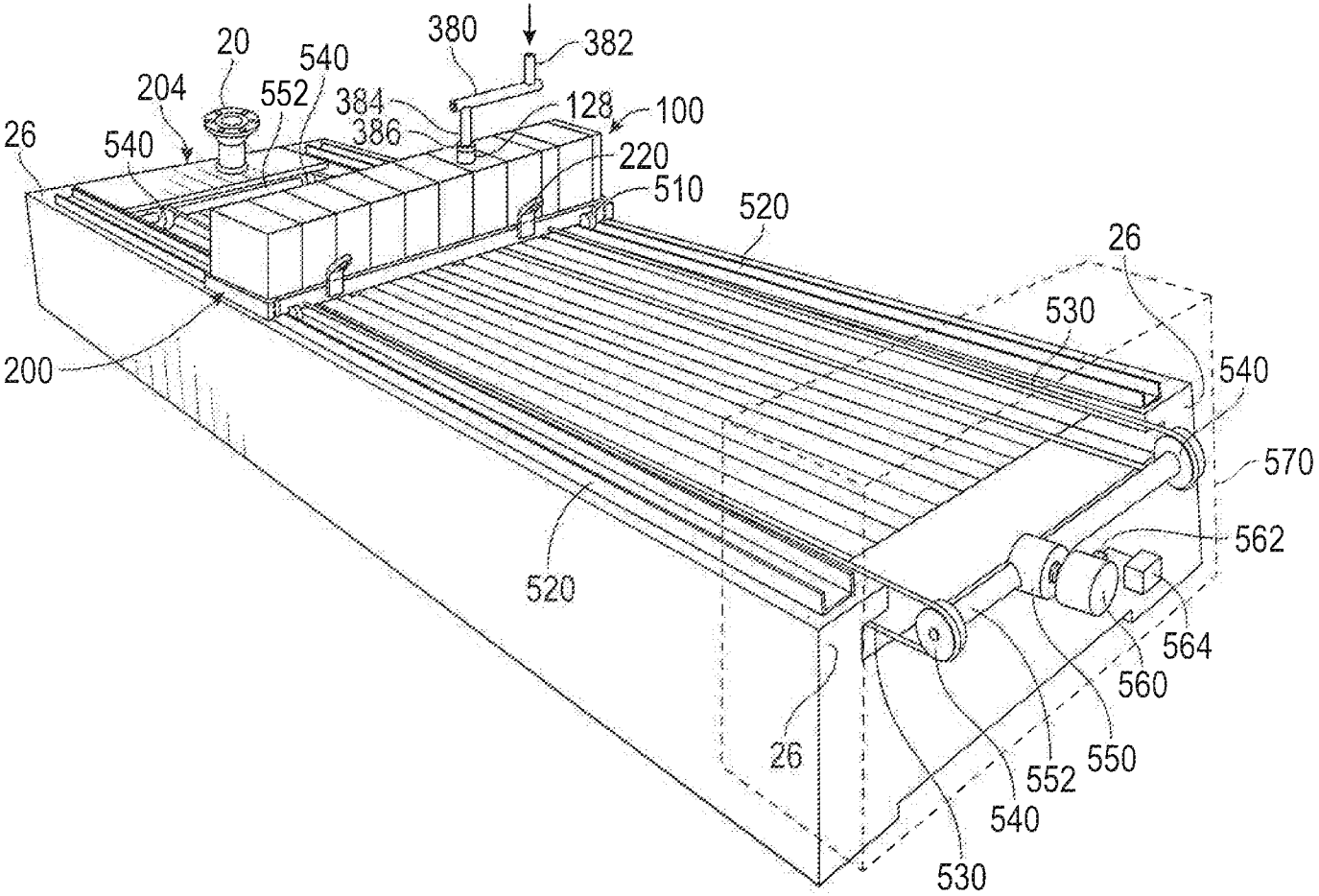
FIG. 8 is a simplified perspective view of the ACHE and the embodiment of the cleaning apparatus of FIG. 6.

As shown in FIGS. 7 and 8, the tracks (520) that are secured on the upper surface of the flange (26) are U-shaped channels which extend to a portion of the housing over the return header (12B). In the alternative, the tracks (520) can be in the form of L-channels or C-channels having arms dimensioned to maintain the wheels in position. This extension of the track (520) provides a storage location for the cleaning assembly that is out of the direct air flow of the cooling air that is passed through the tube bundles, thereby avoiding any loss in the efficiency or performance characteristics of the ACHE during its operation.

As will be understood, the cleaning system could be used during operation of the ACHE where the air flow is downward through the tube bundles. In those plant installations where the cooling air fans are positioned below the elevated structure of the ACHE, the present cleaning system can be installed for operation in substantially the same configuration so that the cleaning fluid is passed from the cleaning nozzles upwardly in the same direction as the cooling air flow. Where the installation of the system is below the ACHE, the tracks will be supported on a separate assembly that is suspended from the ACHE structural members above. The manifold assembly is also positioned below the supporting frame (not shown).

In either of the downwardly or upwardly discharge configurations, the manifold carrying the pressurized fluid from the remote source is conveniently fed by a flexible conduit, e.g., a hose, at least a portion of which travels longitudinally over the tube bundles with the cleaning system. Supporting and transport systems are well known in the art for maintaining the hose in the desired position during movement of the cleaning assembly.

Figure 6:
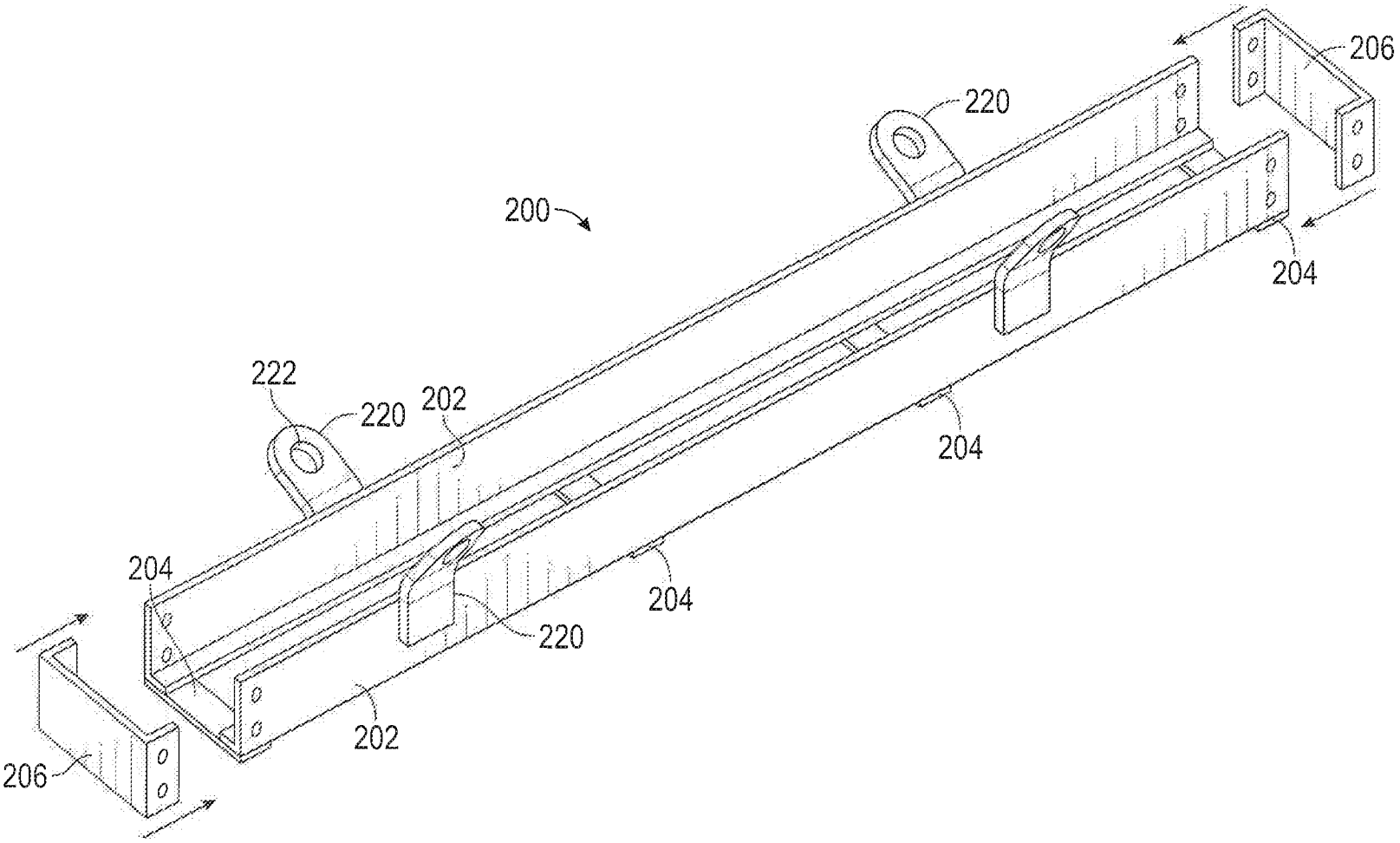
FIG. 6 is a partially exploded side and left end perspective view of the supporting frame member shown in FIGS. 2 and 2B.

When the cleaning assembly is moved to the storage position, a protective cover (570) shown in phantom in both FIGS. 6 and 7 is provided to protect the unit from environmental conditions. The protective cover (570) can be fabricated from known materials and can be either permanently installed on the ACHE or configured as a portable unit that can be removed during cleaning operations and returned to supporting brackets or the like and secured there when the cleaning assembly is not in use.

As best shown in FIG. 7, the supporting frame (200) is fitted at one end with a compressing apparatus (250) that is dimensioned and configured to apply a compressive force F to the exposed side wall of the adjacent fluid compartment (370) in order to maintain an abutting relation between the compartments in the assembly (100). As illustrated in FIG. 7, the compressing apparatus (250) comprises a compression actuator (252), here illustrated as a manually adjustable screw mechanism opposite a compression plate (254). As will be understood from the earlier description, the compressive force F functions in the embodiment of both FIGS. 2A and 2B, where it is important to maintain the fluid compartments immobilized in the desired position to assure the effective distribution of the spray from the nozzles onto the fins and tubes in the proper alignment. The compressive force F is particularly important for the embodiment of FIG. 2B in order to assure the compression and deformation of the annular seals to provide a fluid-tight passage between all of the compartments in the assembly.

While the invention has been described in conjunction with several embodiments, it is to be understood that many alternatives, modifications and variations will be apparent to those skilled in the art based on this description. Accordingly, the scope of the invention is to be determined by the claims that follow.

The invention claimed is:

1. A cleaning system which is permanently positionable in spaced-apart relation above an uppermost tube bundle or below a lowermost tube bundle of an ACHE and configured for reciprocating movement along longitudinal axes of finned heat exchange tubes forming the uppermost tube bundle or the lowermost tube bundle, the cleaning system comprising:

a transversely mounted spray head assembly extending across the longitudinal axes of the finned heat exchange tubes forming the uppermost or lowermost tube bundle, the spray head assembly comprising a plurality of interchangeable fluid compartments that are securely assembled in close-fitting relation with one another to span a width of an opening of the ACHE containing the uppermost or lowermost tube bundle, each interchangeable fluid compartment having an inlet for admitting a pressurized cleaning fluid, the spray head assembly having at least one fluid conduit in fluid communication with the plurality of interchangeable fluid compartments and with an external source of the pressurized cleaning fluid, each of the plurality of interchangeable fluid compartments having a fluid discharge wall proximate the uppermost or lowermost tube bundle, each fluid discharge wall having one or more spray nozzles in fluid communication with the interior of the interchangeable fluid compartment, the one or more spray nozzles generally aligned with the longitudinal axes of the finned heat exchange tubes forming the uppermost or lowermost tube bundle and configured to direct a spray of the pressurized cleaning fluid onto and between the finned heat exchange tubes during movement of the spray head assembly.

2. The cleaning system of claim 1 in which at least one of each of the one or more spray nozzles in the discharge wall are configured to discharge a pressurized spray pattern having a central longitudinal axis aligned with the longitudinal axis of a finned heat exchange tube to which the nozzle is proximate.

3. The cleaning system of claim 1 in which each of the plurality of interchangeable fluid compartments comprises the fluid discharge wall provided with at least one spay nozzle for discharging the pressurized cleaning fluid in at least one predetermined spray pattern that is directed to a finned heat exchange tube.

4. The cleaning system of claim 3 in which each of the plurality of interchangeable fluid compartments comprises a plurality of spray nozzles forming a spaced-apart array, each spaced-apart array of spray nozzles being aligned with finned heat exchange tubes to which they are adjacent when the spray head assembly is in an operable cleaning position on the ACHE.

5. The cleaning system of claim 1 in which the spray nozzles are separate units that are mounted in fluid-tight relation to an exterior surface of each of the interchangeable fluid compartments proximate the uppermost or lowermost tube bundle when the system is in operation.

6. The cleaning system of claim 1 in which slotted nozzles are formed in the fluid discharge wall by molding, cutting and/or drilling the fluid discharge wall.

7. The cleaning system of claim 1 in which each of the interchangeable fluid compartments has at least three transversely spaced spray nozzles, at least one of which spray nozzles discharges a spray of the pressurized cleaning fluid in a generally vertical direction to contact and pass through the uppermost or lowermost tube bundle.

8. The cleaning system of claim 1 in which the plurality of interchangeable fluid compartments are maintained in alignment by at least one longitudinal member positioned below the spray head assembly.

9. The cleaning system of claim 8 in which the spray head assembly is supported by a pair of longitudinal members, the opposite ends of each longitudinal member being securely joined in parallel relation by a transverse end member to form a rigid rectilinear supporting frame structure on which the spray head assembly is mounted.

10. The cleaning system of claim 9 in which the longitudinal members are further joined by a plurality of spaced-apart cross members at locations predetermined to be displaced from the spray nozzles positioned in the supported plurality of interchangeable fluid compartments.

11. The cleaning system of claim 1 further comprising a transport mechanism operably coupled to the spray head assembly, the transport mechanism including a drive motor and drive pulleys and activated by the drive motor to move the spray head assembly longitudinally adjacent to surfaces of the finned heat exchange tubes.

12. The cleaning system of claim 11 which further comprises a pair of parallel supporting tracks securely mounted on opposing housing side walls of the ACHE that are parallel to the longitudinal axes of the finned heat exchange tubes, the tracks being dimensioned and configured to receive the spray head assembly and transport mechanism, the tracks extending to a position at one or both ends of the ACHE in which the spray head assembly is displaced from an open region containing the uppermost or lowermost bundle when the spray head assembly is not in use.

13. The cleaning system of claim 12 in which the transport mechanism comprises wheels and the tracks are U-shaped, or C-shaped or L-shaped channels.

14. The cleaning system of claim 1, wherein each of the plurality of interchangeable fluid compartments abuts at least another one of the plurality of interchangeable fluid compartments.

15. The cleaning system of claim 1, wherein at least one of the plurality of interchangeable fluid compartments has a different size from another one of the plurality of interchangeable fluid compartments.

* * * * *